US006408647B1

(12) United States Patent
Koll

(10) Patent No.: US 6,408,647 B1
(45) Date of Patent: Jun. 25, 2002

(54) ROTATING DESIGN ELEMENT FOR A JEWELRY ITEM

(76) Inventor: Joseph C. Koll, 3901 Wanda Lynn Dr., Metairie, LA (US) 70002

( * ) Notice: Subject to any disclaimer, the term of this patent is extended or adjusted under 35 U.S.C. 154(b) by 0 days.

(21) Appl. No.: 09/440,009

(22) Filed: Nov. 12, 1999

Related U.S. Application Data

(63) Continuation-in-part of application No. 09/173,083, filed on Oct. 14, 1998, now abandoned.

(51) Int. Cl.[7] ..... A44C 17/02
(52) U.S. Cl. ..... 63/31; 63/26
(58) Field of Search ..... 63/26, 31

(56) References Cited

U.S. PATENT DOCUMENTS

| | | | | | |
|---|---|---|---|---|---|
| 340,108 | A | * | 4/1886 | Gaensslen | 63/31 |
| 635,826 | A | * | 10/1899 | Wandry | 63/31 |
| 1,025,447 | A | * | 5/1912 | Blume | 63/31 |
| 4,270,366 | A | * | 6/1981 | Green | 63/3 |
| 4,764,850 | A | * | 8/1988 | Albanese | 362/35 |

FOREIGN PATENT DOCUMENTS

| | | | | |
|---|---|---|---|---|
| CH | 666996 | * | 9/1988 | 63/31 |
| FR | 2376637 | * | 9/1978 | 63/31 |
| JP | 53-8265 | * | 1/1978 | 63/31 |
| NL | 8702093 | * | 4/1989 | 63/31 |

* cited by examiner

*Primary Examiner*—B. Dayoan
*Assistant Examiner*—Andrea Chop
(74) *Attorney, Agent, or Firm*—Kenneth L Tolar

(57) ABSTRACT

A jewelry item having an automatically rotatable design element such as a gem stone includes a substantially cylindrical housing having a bottom wall, a cylindrical side wall vertically depending therefrom with a select design element mounted therein. The bottom end of the housing includes an internally threaded aperture for threadedly engaging a drive shaft on a micro-motor assembly. The micro-motor assembly includes a casing mounted to a jewelry item and is selectively powered by a battery. Accordingly, when a switch is activated, the design element housing will automatically rotate relative to the casing to provide a novelty jewelry item having an enhanced, aesthetic appearance.

12 Claims, 4 Drawing Sheets

1
2
18
101
101
5
17
101
11
10
16
25
3
6
15

ROTATING DESIGN ELEMENT FOR A JEWELRY ITEM

This application is a continuation-in-part of application Ser. No. 09/173,083 filed on Oct. 14, 1998, now abandoned.

BACKGROUND OF THE INVENTION

The present invention relates to a jewelry item having an automatically rotatable, ornamental design element thereon.

DESCRIPTION OF THE PRIOR ART

Various jewelry items such as pins, pendants, brooches, necklaces, rings, watches and similar jewelry are typically worn to aesthetically enhance a wearer's appearance. Various prior art or conventional jewelry items include movable design elements to further enhance the aesthetic effect and novelty thereof. However, with the conventional devices, the jewels or stones are moved manually or with gravitational forces. Such manual drive means are burdensome to operate and are limited in the duration and speed with which the design element is moved. The present invention provides a jewelry item having an ornamental design element that is rotatable with a micro-motor. Accordingly a user may rotate the element for a desired duration by simply activating a switch means.

Various jewelry items having movable design elements exist in the prior art. For example, U.S. Pat. No. 4,977,757 issued to Mesica et al relates to a ring having rotatably mounted and removable ornamental elements. The base of the ring includes a pair of ears for supporting a spindle with the elements threaded thereto allowing the various elements to be disassembled and reorganized.

U.S. Pat. No. 4,270,366 issued to Green relates to a necklace comprising a journal having an axial shank rotatably extending therethrough. A gem stone is mounted on a first end of the shank with the second end having a radially, outwardly extending lever structure that frictionally engages underlying clothing or skin of the wearer to effect angular displacement of the shank member relative to the journal.

U.S. Pat. No. 4,187,697 issued to Castelo relates to a jewel mounting structure comprising a stone secured to mounting sleeves which slidably move along a curved guide surface having a predetermined radius of curvature. A connector depends radially inwardly from the sleeve and is journaled about a shaft at the center of curvature of the guide surface. Attached to the journaling element is a weighted enclosure which causes the sleeve to rotate about the shaft until gravity maintains the enclosure at the lowest point of its circular arc.

U.S. Pat. No. 3,247,683 issued to Dankner relates to a rocking charm having a figurine thereon such as a horse which reciprocally rocks with an internally disposed wind up motor.

U.S. Pat. No. 2,190,778 issued to Fernandez relates to a moving mechanism for pins, brooches, etc. comprising a circular body having a centrally located aperture with a spring motor therein. Extending from the spring motor is a stem allowing the spring motor to be periodically wound. The spring motor rotates a covered picture support structure.

U.S. Pat. No. 1,025,447 issued to Blume relates to a jewelry article comprising a casing having a spiral spring therein. An end of the spring is attached to the casing with the other end secured to a shaft. The spring, when wound, rotates a design element.

U.S. Pat. No. 831,033 issued to Boismaure relates to a jewel mounting such as a hat pin having a hollow bowl with a collar secured thereto. A pin is secured to the collar and includes a hub concentrically received within a tube with a pair of spiral springs therein. One end of each spring is secured to the pin with the other end protruding from a slot on the tube for maintaining the ball in a constant state of vibration regardless of the pin position.

Although various jewelry items having movable design elements exist in the prior art, none relate to a device having an electrical motor means for automatically rotating a design element for a desired duration.

SUMMARY OF THE INVENTION

The present invention relates to an automatically rotatable design element mounting structure for a jewel item. The device comprises a substantially cylindrical housing having a circular bottom wall with a cylindrical side wall vertically depending therefrom and an open top end. The housing is adapted and dimensioned to receive an ornamental design element such as a gem stone. A micro-motor assembly for rotating the housing includes a hollow cylindrical casing having an electrical coil or stator received therein. The stator includes a central bore that receives a first end of a rotor drive shaft. The opposing end of the shaft is externally threaded for threadedly engaging an aperture on the design element housing. A switch means protrudes from the motor casing for establishing electrical contact between an internally disposed battery means and the stator. Accordingly, upon the switch means being activated, the micro-motor will automatically rotate the housing and the design element received therein for a desired duration. It is therefore an object of the present invention to provide a jewelry item having an ornamental design element that is automatically rotatable with a micro-motor.

It is yet another object of the present invention to provide a jewelry item that provides an enhanced aesthetically pleasing appearance.

It is yet another object of the present invention to provide a jewelry item that allows a user to conveniently and automatically rotate a design element for a desired duration. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
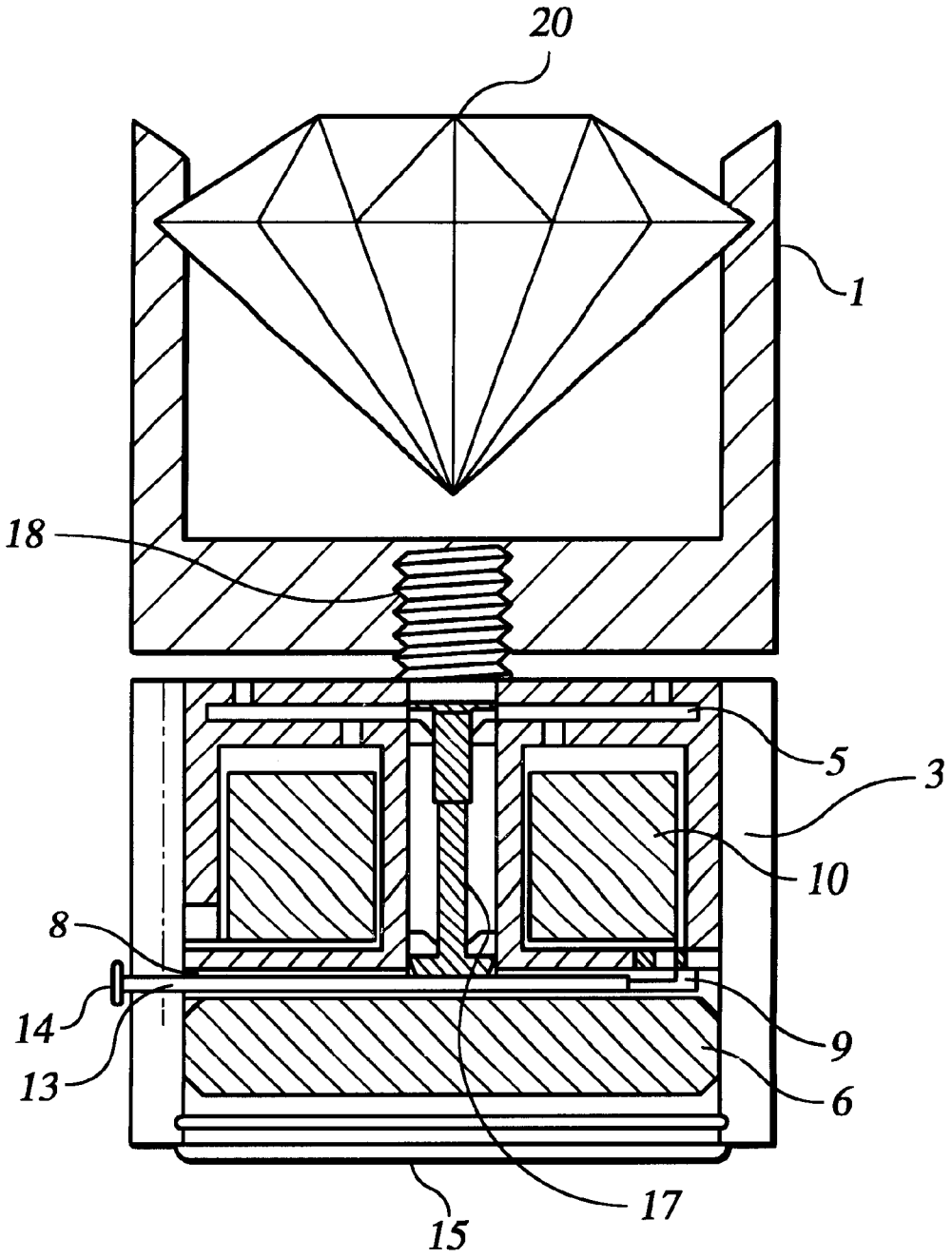
FIG. 1 is a cross-sectional view of the inventive device.
Figure 2:
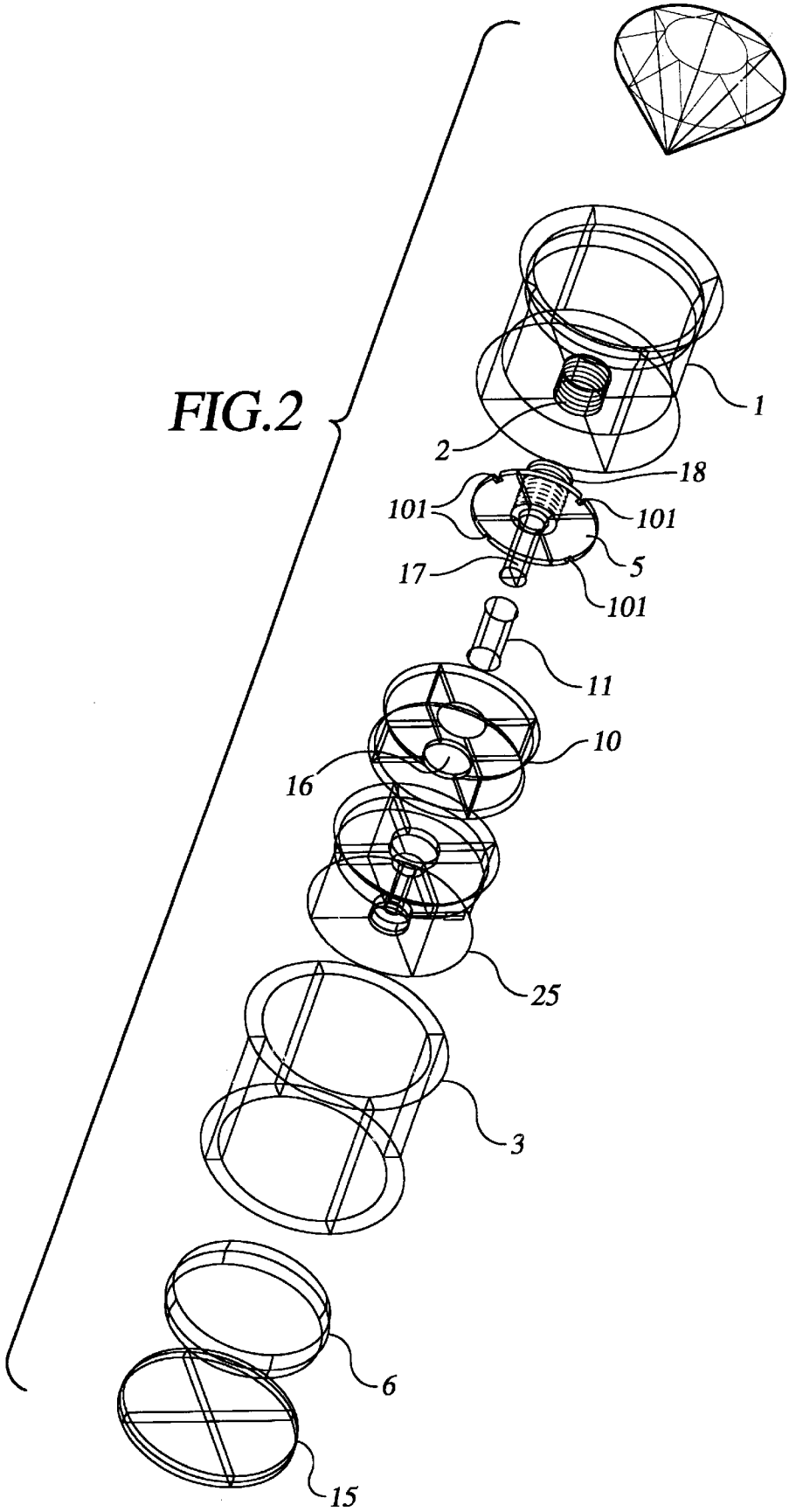
FIG. 2 is a partially exploded, perspective view of the inventive device.

Referring now to FIGS. 1 and 2, the present invention relates to an ornamental design element mounting structure for a jewelry item in which the design element may be selectively rotated for a desired duration. The device comprises a substantially cylindrical housing 1 having a horizontal circular bottom wall with a cylindrical side wall vertically depending therefrom and an open top end. The housing is configured and dimensioned to receive an ornamental design element 20 such as a gem stone. The bottom wall of the housing includes an internally threaded aperture 2 for receiving a threaded shaft from a micro-motor assembly as will be described in more detail below.

The micro-motor assembly includes a substantially cylindrical casing 3 having a stator 10, similar to that found in conventional motor assemblies, received therein. The stator is comprised of a plurality of electrical coil windings having a central bore 16 for receiving a rotor shaft 17. The stator is likewise enclosed within a casing or housing 25.

A bushing 11 is coaxially received within the stator bore to minimize wear and to provide a guide for the rotor shaft. The rotor shaft includes first and second ends, with a first end having an externally threaded portion 18 for threadedly engaging the aperture on the design element housing. The opposing end of the shaft is received within the bushing. An intermediate portion of the shaft includes a substantially circular wing 5 perpendicularly extending therefrom. The wing includes a plurality of magnets 101 selectively disposed thereon whereby the rotor is rotatably driven by the electromagnetic forces generated by the stator when an electric current is applied thereto. Such as construction provides more efficient means for driving the rotor than that of conventional micro motor assemblies.

The micro-motor assembly as described above is selectively powered with a battery means 6 received within the lower end of the motor casing. An electrical contact 9 in communication with the stator is disposed within an elongated horizontal passageway 8 immediately above the upper surface of the battery. A switch means establishes communication between the battery and the contact to activate the motor. The switch means includes an elongated rod 13 coaxially received within the passageway that is vertically movable between an upper and lower position. The rod includes a head member 14 attached to an end thereof that protrudes from the motor casing. The head may be grasped by a user when moving the rod between its two positions. When the rod is moved to its lower position, its distal end simultaneously engages the electrical contact and battery thereby establishing communication between the battery and the stator. A bottom end of the motor casing includes a removable end cap 15 for providing selective access to the battery means.

Figure 3:
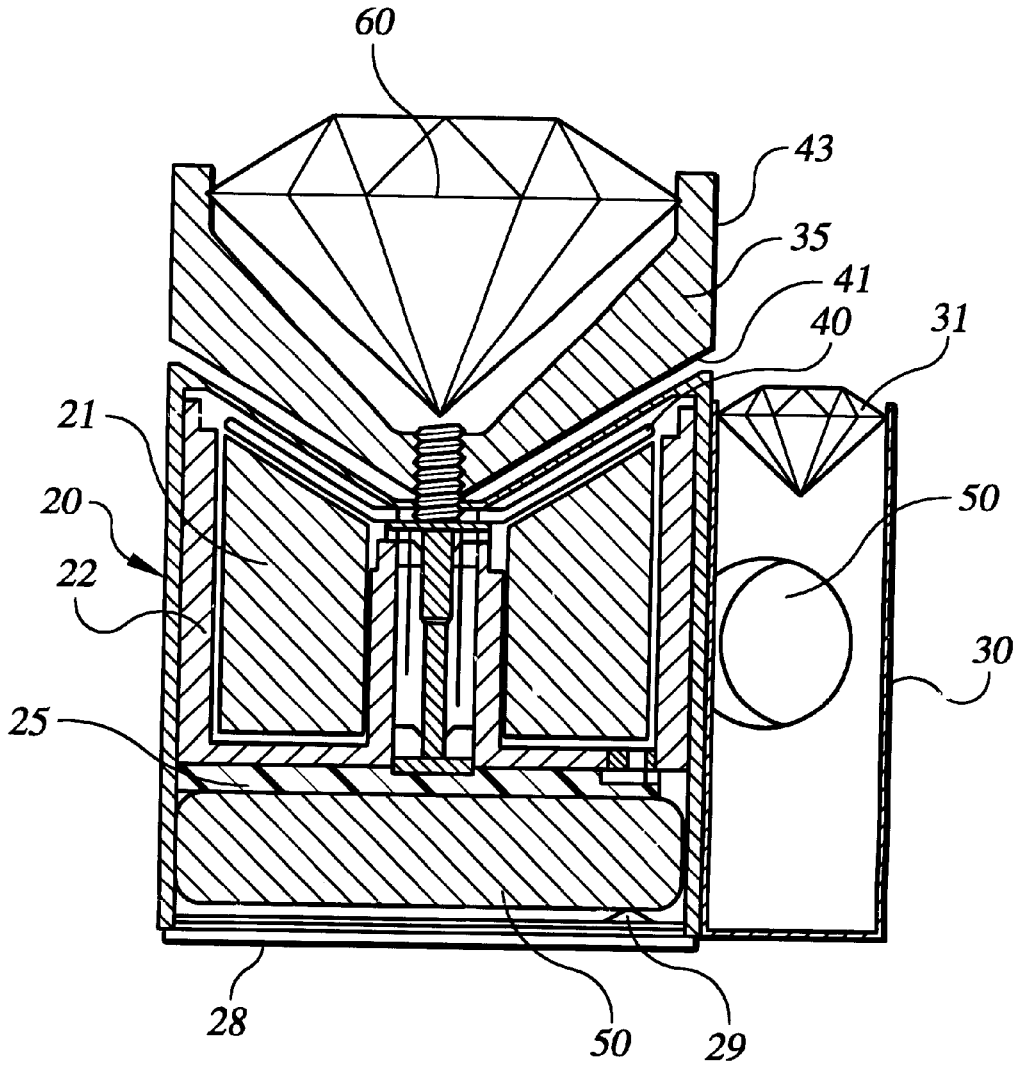
FIG. 3 is a cross-sectional view of a second embodiment.
Figure 4:
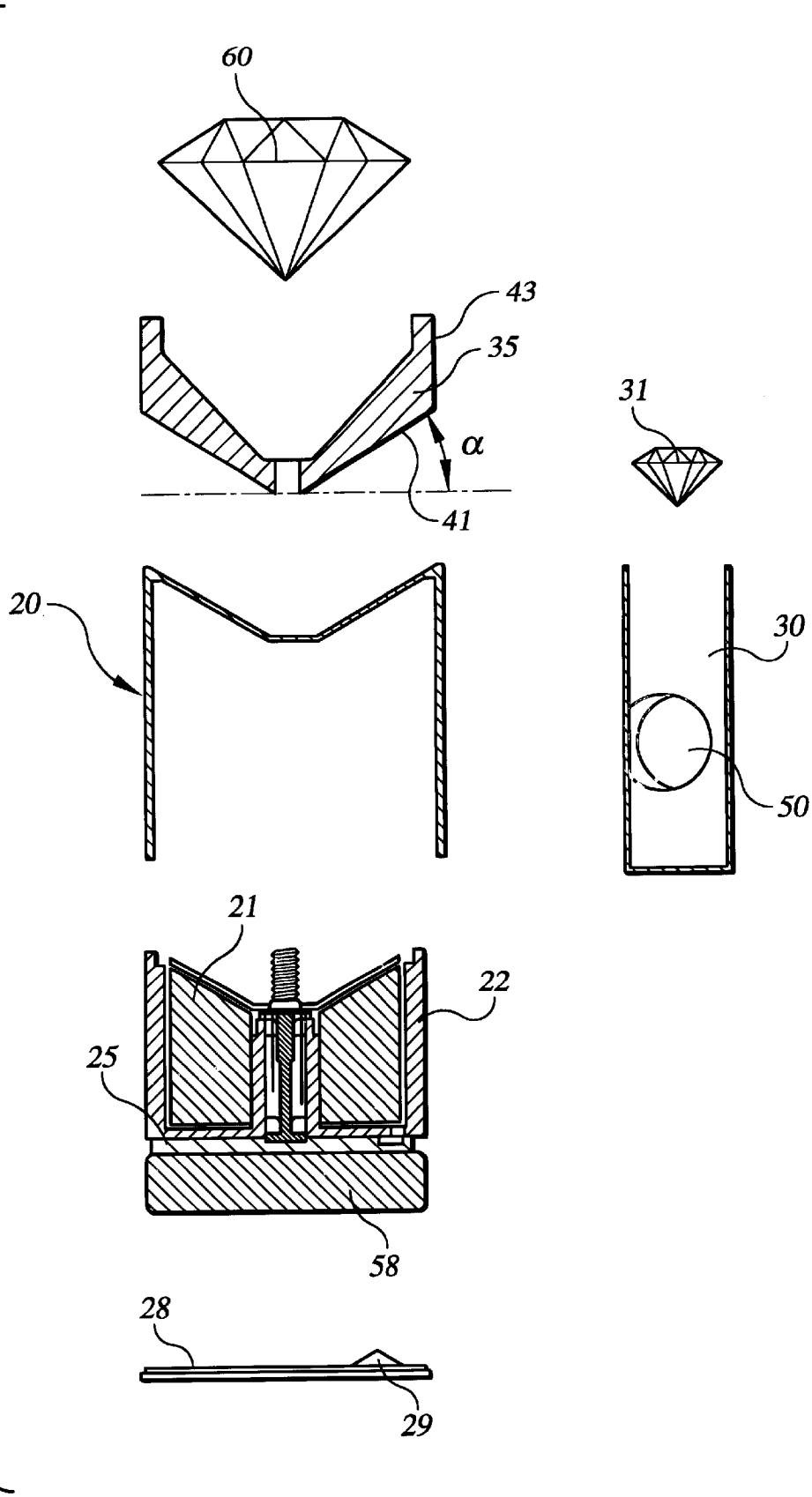
FIG. 4 is an exploded cross-sectional veiw of a second embodiment.

Now referring to FIGS. 3 and 4, a second embodiment of the invention is disclosed. The second embodiment includes a motor casing 20 having a micromotor assembly therein. The micromotor includes a stator 21 and a rotor 40 similar to that described above. The stator is received within a coil housing 22. A circuit board 25 is disposed between a battery means 26 and the micromotor assembly for delivering a predetermined amount of voltage to the motor assembly so that the shaft rotates at a select speed. In the preferred embodiment, the circuit board is configured so that the shaft rotates at approximately 7–10 revolutions per second. The casing is attachable to a select jewelry item such as a watch, necklace, ring, bracelet, etc. The casing also includes a lower removable cap 28 having an electrical contact 29 thereon that establishes electrical communication between a battery 50 and the micromotor assembly.

A housing 35 is mounted to the micromotor drive shaft and has an ornamental design element 60, such as a gemstone, mounted therein. The housing includes a lower portion 41 with a continuous wall 43 extending therefrom. The housing, the rotor, as well as the upper surfaces of the stator and motor casing each have a substantially frustoconical configuration. In the preferred embodiment, the lower portion 41 of the housing extends at a substantially thirty degree angle relative to a horizontal plane (the angle as depicted in FIG. 4), though the angle may be varied to suit a particular application. The frustoconical design of the housing minimizes wobbling and assures a smooth, even rotation.

Preferably, the motor casing 20 and housing 35 have a diameter of less than 7 millimeters while the entire assembly has a height of less than 9 millimeters. However, the size of all of the components may be varied to suit a particular application.

Either of the above described embodiments may also include a bail member 30 having an open top for receiving a second design element 31. The bail includes a bore 58 therethrough for receiving a chain to attach the device to a necklace, bracelet or similar item.

The above described device may be mounted to a desired jewelry item such as a necklace, bracelet, pendant, brooch or any other similar item. If the user desires to rotate the design element for an enhanced aesthetic effect, the switch means is activated and the design element will automatically rotate for a desired duration.

The above described device is not to be limited to the exact details of construction and arrangement of parts shown and described. For example, any conventional micro-motor that accomplishes the result described above may be used. In addition, other conventional switch means may be employed to activate the motor. The device may also include a micro-chip in communication with the battery means that is pre-programmed to drive the motor shaft at a desired speed. The chip delivers a select voltage from the battery to the motor to drive the motor at a predetermined speed. The chip may be preprogrammed to deliver whatever voltage is necessary to drive the motor at the desired speed. Accordingly, a select, pre-programmed micro-chip may be used dependent upon the desired speed, the weight or size of the design element or other similar factors. Furthermore, the shape of the design element housing and the casing may be varied to suit a particular application. Additionally, as will be readily apparent to those skilled in the art, the ornamental design element according to the present invention may be varied, as may the size, shape and materials of construction of the various components, without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A rotating design element assembly for a jewelry item comprising:

a casing attachable to a jewelry item;

a housing having an ornamental design element mounted thereto, said housing rotatably coupled with said casing;

a micro motor received within said casing for automatically rotating said housing relative to said casing to enhance the aesthetic effect of a jewelry item; said micro motor including a rotor shaft with a first end connected to said housing, said shaft having a substantially circular wing on an intermediate portion thereof, said wing having a plurality of magnets positioned thereon; said micro motor further including a stator encompassing said rotor shaft whereby the rotor is rotated by said stator when an electric current is applied thereto.

2. The rotating design element assembly for a jewelry item according to claim 1 further comprising a microchip in communication with a power source and said micro motor for delivering a predetermined voltage thereto to drive the micro motor at a select speed.

3. The rotating design element assembly for a jewelry item according to claim 1 wherein said housing is substantially hollow with the design element received therein, said housing having a substantially frustoconical configuration for minimizing wobbling of said housing when said housing is rotated.

4. The rotating design element assembly for a jewelry item according to claim 1 wherein said design element is a gem stone.

5. The rotating design element assembly for a jewelry item according to claim 1 further comprising a bail member attached to said casing, said bail member having an open top for receiving a second design element, said bail member including a bore therethrough for receiving a portion of a jewelry item.

6. A rotating design element assembly for a jewelry item comprising:

a casing attachable to a jewelry item;

a housing having an ornamental design element mounted thereto, said housing rotatably coupled with said casing;

a micro motor received within said casing for automatically rotating said housing relative to said casing to enhance the aesthetic effect of a jewelry item;

a microchip in communication with a power source and said micro motor for delivering a predetermined voltage thereto to drive the motor at a select speed.

7. The rotating design element assembly for a jewelry item according to claim 6 wherein said housing is substantially hollow with the design element received therein, said housing having a substantially frustoconical configuration for minimizing wobbling of said housing when said housing is rotated.

8. The rotating design element assembly for a jewelry item according to claim 6 wherein said design element is a gem stone.

9. The rotating design element assembly for a jewelry item according to claim 6 further comprising a bail member attached to said motor casing, said bail member having an open top for receiving a second design element, said bail member including a bore therethrough for receiving a portion of a jewelry item.

10. A rotating design element assembly for a jewelry item comprising:

a casing attachable to a jewelry item;

a housing having an ornamental design element mounted thereto, said housing rotatably coupled with said casing;

a micro motor received within said casing for automatically rotating said housing relative to said casing to enhance the aesthetic effect of a jewelry item;

a bail member attached to said casing, said bail member having an open top for receiving a second design element, said bail member including a bore therethrough for receiving a portion of a jewelry item.

11. The rotating design element assembly for a jewelry item according to claim 10 wherein said housing is substantially hollow with the design element received therein, said housing having a substantially frustoconical configuration for minimizing wobbling of said housing when said housing is rotated.

12. The rotating design element assembly for a jewelry item according to claim 10 wherein said design element is a gem stone.

* * * * *